US009634399B1

(12) United States Patent
Harris et al.

(10) Patent No.: US 9,634,399 B1
(45) Date of Patent: Apr. 25, 2017

(54) ANTENNA FOR TRANSMITTING PARTIAL ORBITAL ANGULAR MOMENTUM BEAMS

(71) Applicant: L-3 Communications Corp., New York, NY (US)

(72) Inventors: Johnny M. Harris, Layton, UT (US); Osama S. Haddadin, Salt Lake City, UT (US); Zachary C. Bagley, Salt Lake City, UT (US); Brandon G. Walsh, Syracuse, UT (US); Jonathan C. Landon, Salt Lake City, UT (US)

(73) Assignee: L-3 Communications Corp., New York, NY (US)

( * ) Notice: Subject to any disclaimer, the term of this patent is extended or adjusted under 35 U.S.C. 154(b) by 255 days.

(21) Appl. No.: 14/077,433

(22) Filed: Nov. 12, 2013

(51) Int. Cl.
*H01Q 15/14* (2006.01)
*H01Q 19/10* (2006.01)

(52) U.S. Cl.
CPC ..... *H01Q 19/10* (2013.01)

(58) Field of Classification Search
CPC ..... H04L 5/04; H04J 1/08
USPC ..... 343/912, 913, 915, 914
See application file for complete search history.

(56) References Cited

U.S. PATENT DOCUMENTS 4,712,111 A * 12/1987 Ohta ..... H01Q 25/001 343/779
5,684,494 A * 11/1997 Nathrath ..... H01Q 3/18 343/761
9,031,151 B1 * 5/2015 Harris ..... H04B 7/0617 375/267
2010/0013696 A1 1/2010 Schmitt et al.
2011/0150464 A1 6/2011 Murshid et al.
2012/0319915 A1 12/2012 Roh et al.
2013/0027774 A1 1/2013 Bovino et al.
2013/0106664 A1 5/2013 Igwe
2013/0121330 A1 5/2013 Ashrafi
2013/0235744 A1 9/2013 Chen et al.
2015/0194735 A1 * 7/2015 Graceffo ..... H01Q 21/28 343/836
2016/0028163 A1 * 1/2016 Li ..... H01Q 21/00 343/836

FOREIGN PATENT DOCUMENTS

WO WO2005069443 * 7/2005

OTHER PUBLICATIONS

Edfors et al., "Is Orbital Angular Momentum (OAM) Based Radio Communications an Unexploited Area?," IEEE (2011), pp. 1-7.
Lundin, "Interference and Energy Conservation in Phased Antenna Arrays and Young's Double Slit Experiment," (Dec. 12, 2012), pp. 1-45.

(Continued)

*Primary Examiner* — Hoanganh Le
(74) *Attorney, Agent, or Firm* — Brian Tucker; Kirton McConkie

(57) ABSTRACT

An antenna system can impart orbital angular momentum (OAM) to an incident electromagnetic (EM) signal from a feed antenna. The antenna system can include a partial OAM antenna with a reflective surface that has only part of a full OAM shaped surface. The antenna system can thus reflect the incident EM signal as a partial OAM beam rather than a full OAM beam.

20 Claims, 6 Drawing Sheets

(56) References Cited

OTHER PUBLICATIONS

Mohammadi et al., "Orbital Angular Momentum in Radio—A System Study," IEEE Transactions on Antennas and Propagation, (publication date unknown but prior to Sep. 30, 2013), pp. 1-7.
U.S. Appl. No. 14/077,493, filed Nov. 12, 2013, L-3 Communications Corp.
Ashmawy et al., "Joint MCMA and DD blind equalization algorithm with variable-step size," IEEE (2009), pp. 174-177.
Hung et al., "A Hybrid Variable Step-Size Adaptive Blind Equalization Algorithm for QAM Signals," IEEE Globecom 2005, pp. 2140-2144.
Hung et al., "Variable-Step-Size Multimodulus Blind Decision-Feedback Equalization for High-Order QAM Based on Boundary MSE Estimation," ICASSP 2004 (IEEE 2004), pp. 881-884.
Wei et al., "A Variable Step Size Blind Equalization Algorithm for QAM Signals," ICMMT 2010 Proceedings (IEEE 2010), pp. 1801-1804.
U.S. Appl. No. 14/272,213, filed May 7, 2014, L-3 Communications Corp.

* cited by examiner

ANTENNA FOR TRANSMITTING PARTIAL ORBITAL ANGULAR MOMENTUM BEAMS

BACKGROUND

As is known, electromagnetic (EM) radiation can have a non-zero orbital angular momentum (OAM), and EM beams (e.g., radio frequency beams) with a non-zero OAM can be transmitted and received. FIG. 1A illustrates a simplified, block diagram depiction of an OAM EM beam 102. As shown, the OAM EM beam 102 turns (i.e., twists) about an axis 104 in the direction of propagation of the beam 102. For example, the wave front of the beam 102 can be substantially spiral or helical. The numerical value of the mode m of the beam 102 corresponds to the time or distance (labeled 106 in FIG. 1A) between one full revolution of the beam 102 about the axis 104, and the sign of the mode m corresponds to the direction (e.g., right or left) of the revolutions of the beam 102 about the axis 104.

Multiple OAM beams (each generally similar to beam 102) each in the same frequency band but having a different mode m can be combined and transmitted as a combined transmission from an EM transmitter (not shown). An EM receiver (not shown) can received the combined transmission and separate the multiple OAM beams. The ability to combine multiple beams in the same frequency band provides for the possibility of very high data rate transmissions.

FIG. 1B illustrates an example of a far field pattern 110 of the EM field intensity of a typical OAM beam 102 in a plane that is perpendicular to the direction of propagation (i.e., perpendicular to the axis 104). As shown, much of the far field pattern 110, including a central region 114 around the axis 104 of propagation, has a low EM field intensity. High intensity EM fields tend to be in a ring (corresponding to 112 in FIG. 1B) around the central region 114.

As is known, an EM beam tends to spread out as it propagates. The far field pattern 110 is thus typically much larger than a distant receiving antenna (not shown). It can be difficult, however, to point a transmitting antenna (not shown) at a receiving antenna (not shown) because the high intensity region 112 is not concentrated at the center of the beam 102. Moreover, because the far field pattern 110 in a point-to-point link is typically so much larger than the receiving antenna (not shown), energy in the transmitted beam 102 that is anywhere other than the typically small portion of the far field pattern 110 at which the receiving antenna (not shown) is located is wasted. Some embodiments of the present invention address one or more of the foregoing issues with the prior art and/or provide other advancements and advantages.

SUMMARY

In some embodiments, an antenna system can include a reflector antenna. The surface shape of a reflective face of the antenna can correspond to a partial portion of less than an entirety of a geometric surface that twists around an axis while moving parallel to the axis.

In some embodiments, a transmitting process can include outputting a transmission signal from a feed antenna and reflecting the transmission signal from a reflective face of a partial orbital angular momentum (OAM) antenna, which can impart a non-zero OAM to the transmission signal and thereby reflect the transmission signal away from the partial OAM antenna in the form of a partial OAM beam.

DETAILED DESCRIPTION OF EXEMPLARY EMBODIMENTS

Figure 1A:
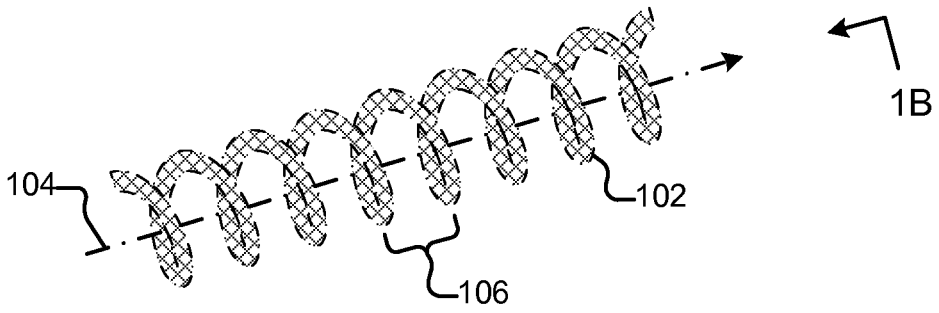
Figure 1A (Prior Art)
FIG. 1A is a simplified, block diagram depiction of a prior art OAM EM beam.
Figure 1B:
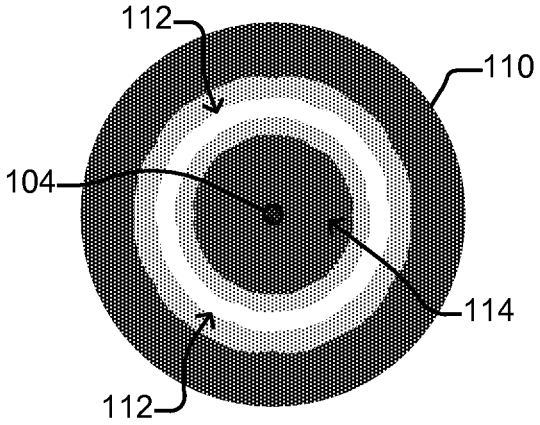
Figure 1B (Prior Art)
FIG. 1B shows an example of a far field EM field intensity pattern of the OAM beam of FIG. 1A.

This specification describes exemplary embodiments and applications of the invention. The invention, however, is not limited to these exemplary embodiments and applications or to the manner in which the exemplary embodiments and applications operate or are described herein. Moreover, the figures may show simplified or partial views, and the dimensions of elements in the figures may be exaggerated or otherwise not in proportion for clarity. In addition, as the terms "on," "attached to," or "coupled to" are used herein, one object (e.g., a material, a layer, a substrate, etc.) can be "on," "attached to," or "coupled to" another object regardless of whether the one object is directly on, attached, or coupled to the other object or there are one or more intervening objects between the one object and the other object. Also, directions (e.g., above, below, top, bottom, side, up, down, under, over, upper, lower, horizontal, vertical, "x," "y," "z," etc.), if provided, are relative and provided solely by way of example and for ease of illustration and discussion and not by way of limitation. In addition, where reference is made to a list of elements (e.g., elements a, b, c), such reference is intended to include any one of the listed elements by itself, any combination of less than all of the listed elements, and/or a combination of all of the listed elements.

As used herein, "substantially" means sufficient to work for the intended purpose. When used with respect to numerical values or parameters or characteristics that can be expressed as numerical values, the term "substantially" means within ten percent. The term "ones" means more than one.

A "spiral" is a three-dimensional curve that winds around an axis at a constant or continuously varying distance while moving parallel to the axis. A three-dimensional curve is substantially a spiral if the three-dimensional curve is within ten percent of each of the foregoing requirements. A "helix" is a three-dimensional curve that winds around an axis through the center of a cylinder or cone and lies on the cylinder or cone such that an angle of the curve to any plane perpendicular to the axis is constant. A three-dimensional curve is substantially a helix if the three-dimensional curve is within ten percent of each of the foregoing requirements. A helix can be an example of a spiral.

The acronym "OAM" means orbital angular momentum, and "EM" means electromagnetic. An "OAM antenna" is an antenna with a reflective surface that is an OAM shaped surface. An "OAM shaped surface" is a geometric surface with curvature that imparts a non-zero OAM to an incident EM signal and thereby reflects the EM signal as an OAM EM beam. An "OAM antenna" is an antenna with an OAM shaped surface. An "OAM beam" refers to EM radiation with a non-zero OAM.

The term "central," as used with reference to a point, area, or region on a surface or of a structure, includes any point, area, or region that is inside of and does not include the outer perimeter of the surface or structure.

Figure 2A:
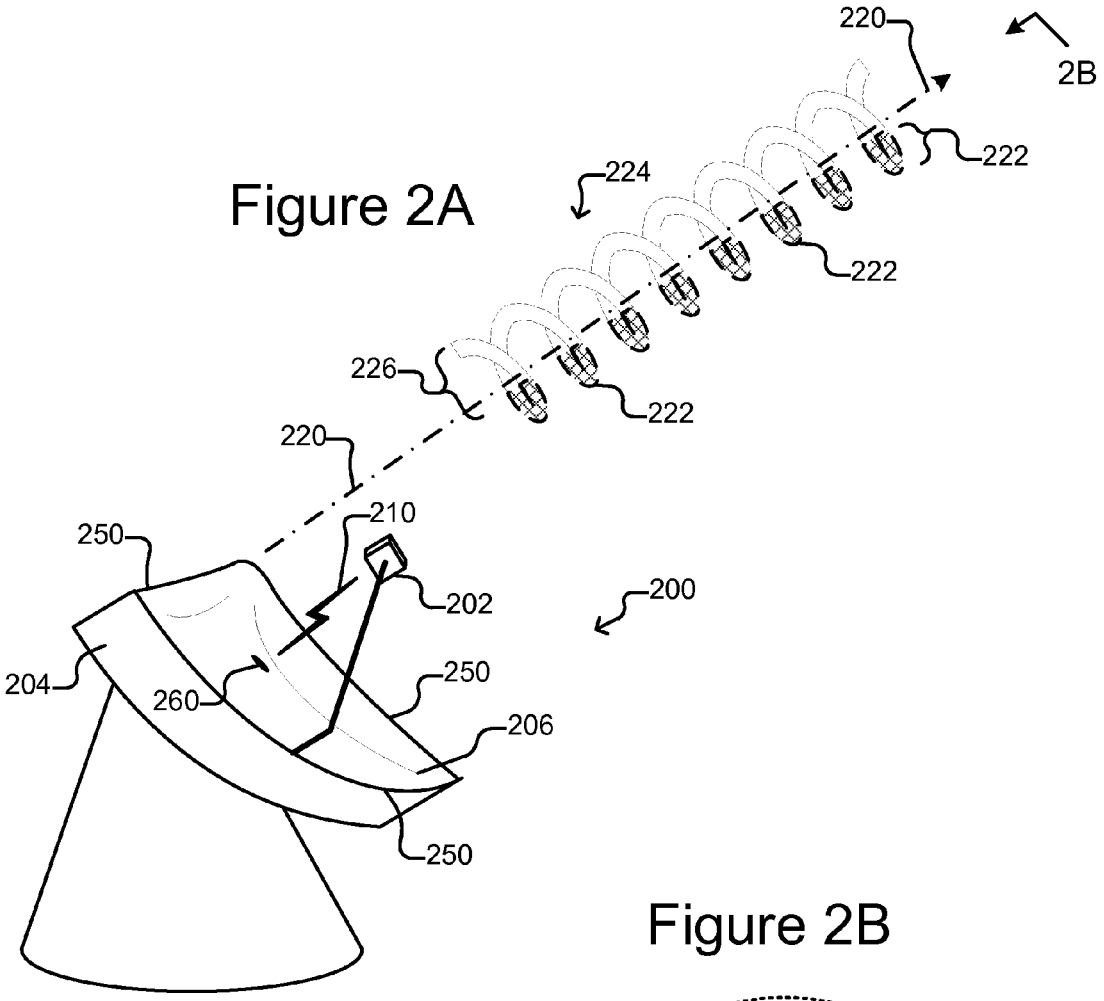
FIG. 2A illustrates an example of an antenna system that includes a partial OAM antenna according to some embodiments of the invention.

Some embodiments of the invention can comprise an antenna system for generating a partial OAM beam. The antenna system can comprise a partial OAM antenna that comprises part but not all of the shape of an OAM shaped surface for generating a full OAM beam. A partial OAM beam can require less power for an equivalent transmission than a full OAM beam, and an antenna that transmits a partial OAM beam can more readily be pointed at a receiving antenna than an antenna that transmits a full OAM beam. FIG. 2A illustrates an example of an antenna system 200 for generating a partial OAM beam 222, and FIG. 2B illustrates an example of a far field pattern 230 of the partial OAM beam 222.

As shown in FIG. 2A, the antenna system 200 can comprise a feed antenna 202 and a partial OAM antenna 204. The feed antenna 202 can be configured to illuminate a reflective face 206 of the partial OAM antenna 204 with a transmission signal 210 (which can have no OAM). The surface shape of the face 206 of the partial OAM antenna 204 can impart non-zero OAM to the transmission signal 210 and thus reflect the transmission signal 210 as a partial OAM beam 222 that twists around and propagates along an axis 220.

The reflective face 206 reflects the transmission signal 210 as a partial OAM beam 222 because, as will be seen, the face 206 is a portion of less than the entirety of a full OAM shaped surface that would otherwise produce a full OAM beam. In FIG. 2A, a full OAM beam (like beam 102 of FIG. 1A) is labeled 224, and the missing portion of the full OAM beam 224 is labeled 226 and depicted with dashed lines. As can be seen, the partial OAM beam 222 is a portion of less than an entirety of the full OAM beam 224.

Figure 2B:
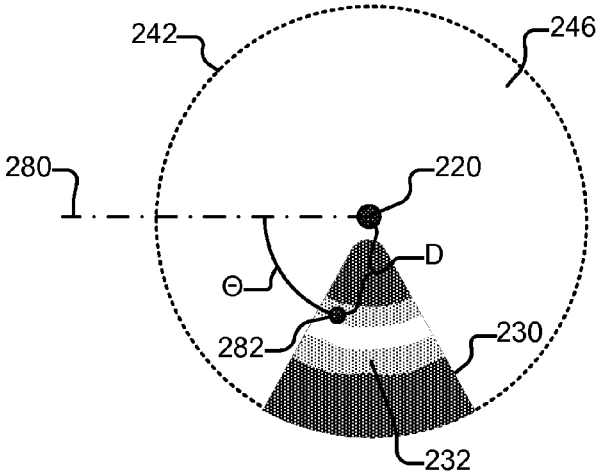
FIG. 2B is an example of a far field EM field intensity pattern of a partial OAM beam transmitted by the antenna system of FIG. 2A.
Figure 3A:
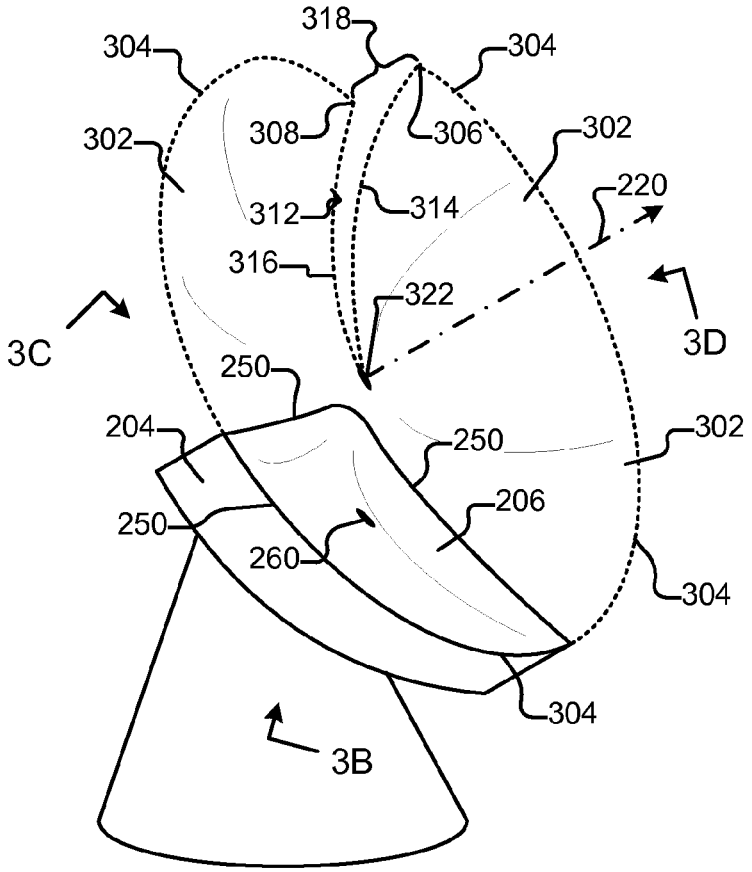
FIGS. 3A-3D illustrates that the reflective face of the partial OAM antenna of FIG. 2A can be a portion of a full OAM shaped surface according to some embodiments of the invention.
Figure 3B:
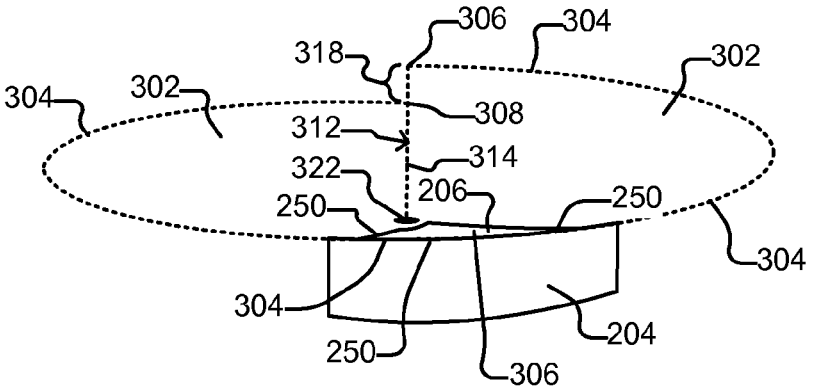
Figure 3C:
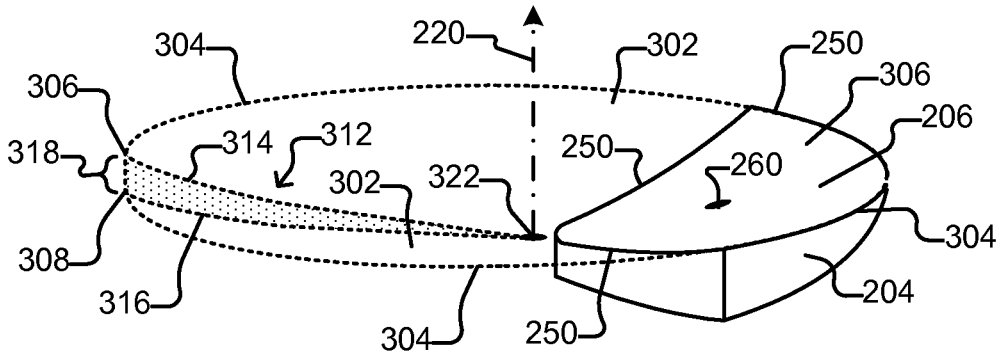
Figure 3D:
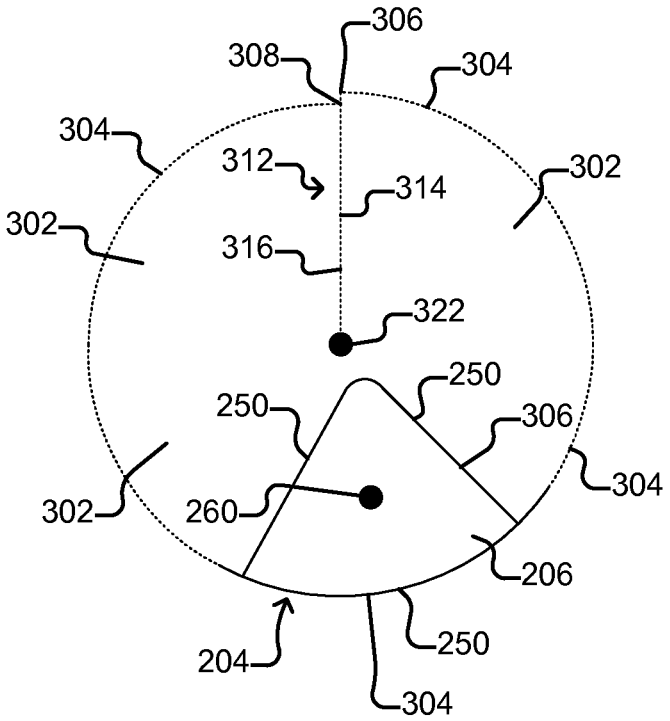

FIG. 2B illustrate a simplified depiction of the far field pattern 230 of the partial OAM beam 222 including a high intensity EM field region 232. The pie shape of the fair field pattern 230 illustrated in FIG. 2B can correspond to the shape of the face 206 of the antenna 204. In practice, however, the partial beam 222 spreads out, and the far field pattern 230 thus might not look like the pie shape shown in FIG. 2B. Nevertheless, in FIG. 2B, the outline of what would be an example of a far field pattern of the full OAM beam 224 is labeled 242, and the missing portion of the far field pattern is labeled 246 and outlined with a dashed line.

Regardless of its shape, the far field pattern 230 of the partial OAM beam 222 can be a fraction of the far field pattern 242 of the corresponding full OAM beam 224, and the antenna system 200 can thus transmit the partial OAM beam 222 with greater power efficiency than an antenna system that transmits a similar but full OAM beam (e.g., 224). Moreover, because at least part of the high intensity field portion 232 can be located generally centrally in the far field pattern 230, the antenna 204 can be more readily pointed at a receiving antenna (not shown) than a comparable antenna for transmitting the full OAM beam 224.

The intensity of EM fields at different points 282 (one is identified in FIG. 2B) in the far field pattern 230 can by generally or substantially uniform over a range of different values of an angle Θ from a reference axis 280 (that is perpendicular to the axis 220) to each of the different points 282. The intensity of the EM fields can vary, however, over a range of values of a distance D from the axis 220 to each of the different points 282. In contrast, the phase profile of the EM fields at the points 282 can by generally or substantially uniform over a range of values of the distance D, but the phase profile can vary over a range of values of the angle Θ. The foregoing results in the partial OAM 222 having a rotating wave front characteristic of a non-zero OAM beam.

Referring again to FIGS. 2A and 2B, as noted, the reflective face 206 of the partial OAM antenna 204 can correspond to a portion of less than an entirety of an OAM shaped surface for producing the full OAM beam 224. That is, the perimeter 250 of the face 206 can be a cut out from a full OAM shaped surface. FIGS. 3A-3D illustrate an example.

In FIGS. 3A-3D, an example of a full OAM shaped surface 302 for producing the full OAM beam 224 is shown in dashed lines. That is, the OAM shaped surface 302 can be a geometric surface that, if incorporated into a reflective antenna as the reflective surface, would impart OAM to an incident transmission signal and reflect the transmission signal as a full OAM beam like beam 224 in FIG. 2A. In FIGS. 3A-3D, however, the OAM surface 302 is a geometric surface but not a structural surface and merely illustrates that the face 206 of the partial OAM antenna 204 is part of, and thus can be a cut out from, the full OAM shaped surface 302.

The full OAM shaped surface 302 in FIGS. 3A-3D can have any one or more of the following characteristics. The axis 220 about which the partial OAM beam 222 twists as it propagates can pass through a central point 322 of the surface 302. The central point 322 can be, for example, substantially at the center of the OAM shaped surface 302. The OAM shaped surface 302 can be bound by an outer perimeter 304, a first edge 314, and a second edge 316, and there can be a discontinuity 312 (e.g., a step) between the first edge 314 and the second edge 316. The surface 302 can extend from the outer perimeter 304 to a central point 322 of the OAM shaped surface 302. The surface 302 can be curved or comprise a curve from points (e.g., every point or all of the points except the first point 306 and the second point 308) on the perimeter 304 to the central point 322, and any such curvature of the surface 302 from a point on the perimeter 304 to the central point 322 can be concave and/or substantially parabolic. The first edge 314 and/or the second edge 316 can thus be curved concavely and/or can comprise a substantially parabolic curve. The perimeter 304 can extend from a first point 306 to a second point 308, and the first point 306 and the second point 308 can be separated by a non-zero distance 318, which can correspond to the mode m of the partial beam 222 shown in FIG. 2A. That is, the distance 318 can correspond to an amount of phase change of EM fields in the far field pattern 230 as the partial OAM beam 222 makes a complete revolution around the axis 220 as the beam 222 is propagating away from the antenna 204. (See FIGS. 2B and 2C.) For example, the distance 318 can be substantially equal to one half wavelength of the partial OAM beam 222, in which case the partial beam 222 can be a mode one beam. As another example, the distance 318 can be substantially equal to one wavelength of the partial OAM beam 222, in which case the partial beam 222 can be a mode two beam.

Additional possible characteristics of the full OAM shaped surface 302 in FIGS. 3A-3D can include one or more of the following. The first point 306 and the second point 308 can be on a line that is substantially parallel to the axis 220 through the central point 322. The first edge 314 can be a line (which can be straight or curved, continuous or discontinuous) from the first point to a central point 322 on the surface 302, and the second edge 316 can be a line (which can be straight or curved, continuous or discontinuous) from the second point 308 to the central point 322. The first edge 314, the second edge 316, and the axis 220 can be substantially on the same plane. From the first point 306 to the second point 308, the outer perimeter 304 of the surface 302 can twist about the axis 220 while moving along the axis 220. The perimeter 304 can be substantially a spiral around the axis 220, and in some embodiments, the perimeter 304 can be substantially a helix around the axis 220. From the first point 306 to the second point 308, the perimeter 304 can make substantially one complete revolution around the axis 220. From the first edge 314 to the second edge 316, the surface 302 can turn (i.e., twist) about the axis 220. The surface 302 can turn about the axis 220 in a substantially spiral or substantially helix pattern. The surface 302 can make substantially one complete revolution around the axis 220.

The shape of the surface 302 shown in FIGS. 3A-3D is an example, and variations are contemplated. For example, although the edges 314, 316 are illustrated as both ending at the central point 322, the edges 314, 316 can alternatively end at points that are spaced apart. For example the edges 314, 316 can end on points that are on the axis 220 and spaced apart.

Figure 4:
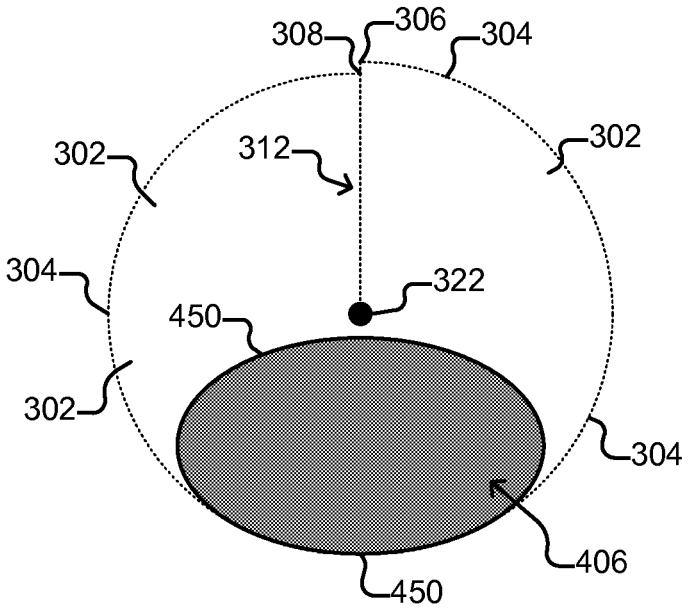
FIGS. 4-6 illustrate additional examples of shapes of a reflective face of a partial OAM antenna according to some embodiments of the invention.
Figure 5:
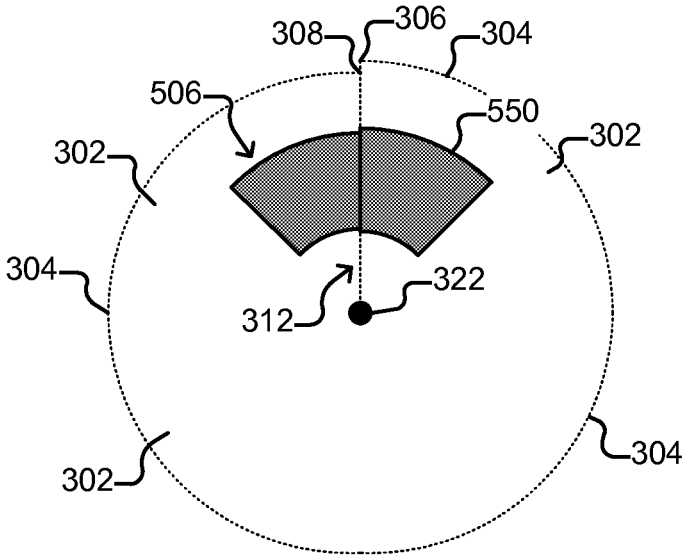
Figure 6:
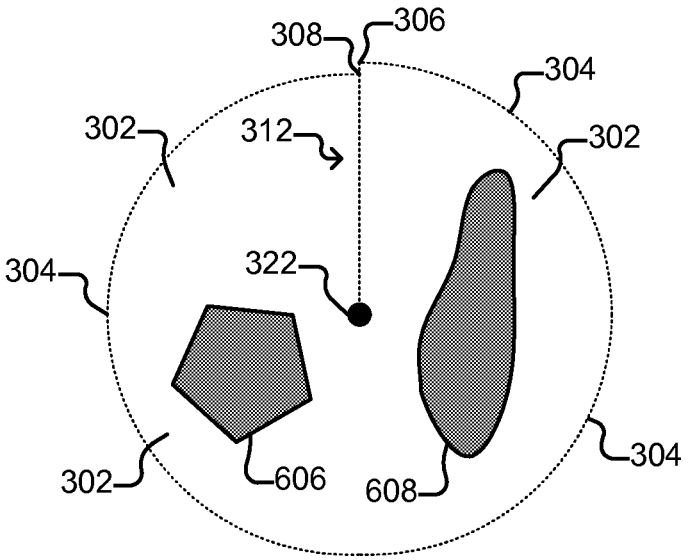

Although the perimeter 250 of the face 206 of the partial OAM antenna 204 is illustrated in FIGS. 2A-3D as a pie shaped portion of the full OAM shaped surface 302, the perimeter 250, and thus the face 206, can be any shape and in any location on an OAM shaped surface 302 as long as the reflected beam 222 has non-zero OAM. That is, the perimeter 250 of the reflective face 206 of the antenna 204 can be any shape from and in any location on the OAM shaped surface 302 as long as the reflective face 206 imparts non-zero OAM to the transmission signal 210 and thus reflects the transmission signal 210 as a partial OAM beam 222 with non-zero OAM. There can be performance differences (e.g., focused power, shape of high intensity fields 232 in a far field pattern 230, etc.) among different shapes. FIGS. 4-6 illustrate non-limiting examples of alternative shapes and locations of the perimeter 250 and thus the reflective face 206 of the antenna 204.

FIG. 4 illustrates an example of an alternative shape of the perimeter 250 of the face 206 of FIG. 2A. As shown, the face 206 can have the perimeter 450 of the shape 406 rather than the pie shape shown in FIGS. 2A-3D. As can be seen in FIG. 4, the perimeter 450 can be in the shape of an ellipse cut out from the full OAM shaped surface 302. The shape of the perimeter 450 can alternatively be circular. The shape of the perimeter 250 of the face 206 of the partial OAM antenna 204 in FIG. 2A can thus alternatively be elliptical or circular.

FIG. 5 illustrates another example of an alternative shape of the perimeter 250 of the face 206 of FIG. 2A. As shown, the face 206, rather than the pie shape illustrated in FIGS. 2A-3D, can be in the shape of a partial circular segment 506 and/or can cross the discontinuity 312 and thus comprise portions of the surface 302 on both sides of the discontinuity 312.

FIG. 6 illustrates additional examples of alternative shapes for the perimeter 250 of the face 206 including a pentagon shape 606 and an irregular shape 608. FIG. 6 also illustrates that the face 206 can include more than one partial portion of surface 302. For example, rather than the pie shape illustrated in FIGS. 2A-3D, the perimeter 250 of the face 206 of the partial OAM antenna 204 can include more than one shape cut out from the full OAM shaped surface 302. For example, the face 206 can comprise both of the shapes 606, 608 shown in FIG. 6.

The reflective face 206 of the partial OAM antenna 204 can thus correspond to (i.e., be) any portion or portions of an OAM shaped surface 302, and the outer perimeter 250 of the reflective face 206 of the partial OAM antenna 204 can be any shape at any location on the OAM shaped surface 302. Moreover, the reflective face 206, regardless of the shape of the perimeter 250, can be less than the entirety of the OAM shaped surface 302. For example, the face 206 can be less than eighty percent, less than sixty percent, less than fifty percent, less than thirty percent, less than twenty percent, or less than ten percent of the entirety of the OAM shaped surface 302. As other examples, the face 206 can be between ten percent and eighty percent (inclusive), between fifteen and fifty percent (inclusive), or between ten percent and forty percent (inclusive) of the entirety of the OAM shaped surface 302.

Referring again to antenna system 200 of FIG. 2A, the feed antenna 202 of FIG. 2A can be any antenna for directing a transmission signal 210 in the form of electromagnetic (EM) radiation onto the partial OAM antenna 204. Suitable examples of the feed antenna 202 include one or more horn antennas. The feed antenna 202 can be positioned to point—and thus direct the center of the transmission signal 210—at a feed target 260, which can be a point or region on the face 206 of the partial OAM antenna 204. For example, the feed target 260 can be substantially at a central point or even at a center of the face 206. Regardless, the feed antenna 202 can be positioned and configured to illuminate substantially all, most, or more than half of the face 206.

The partial OAM antenna 204 can be a reflector type antenna for reflecting the transmission signal 210 from the feed antenna 202. The partial OAM antenna 204 can thus be any type or configuration of an EM reflector type antenna such as a dish type reflector antenna. The reflective face 206 of the partial OAM antenna 204 can be an EM reflective surface that reflects incident EM radiation.

Figure 7:
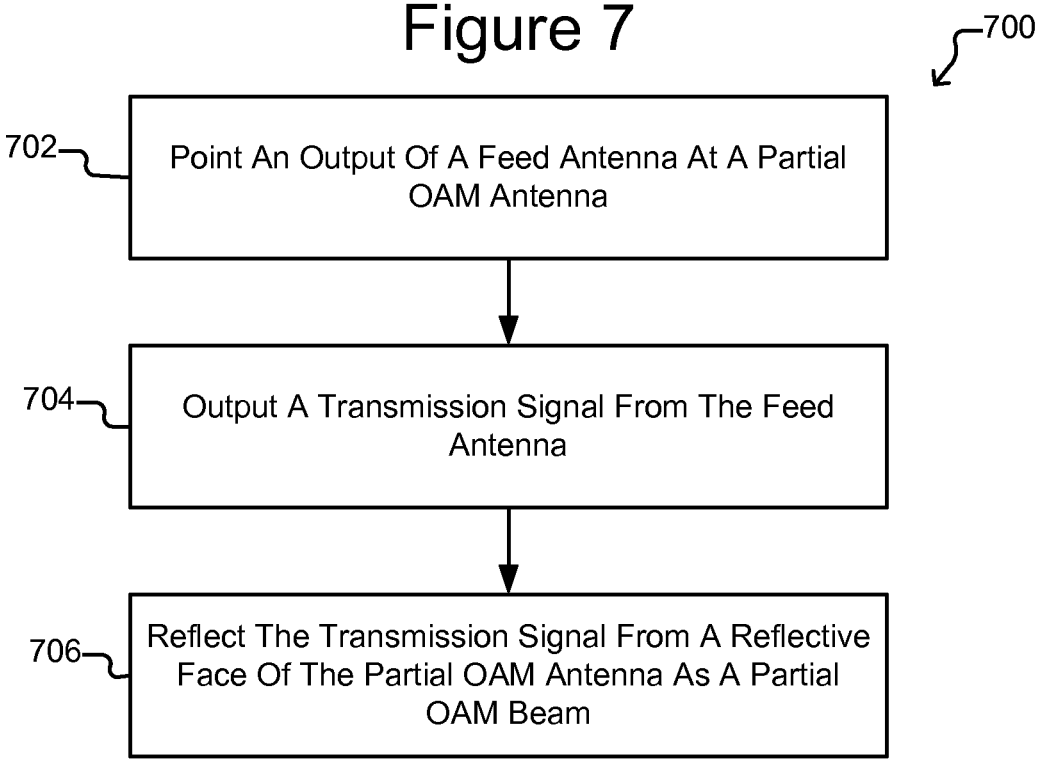
FIG. 7 is an example of a process for transmitting a partial OAM beam according to some embodiments of the invention.

FIG. 7 is an example of a process 700 for generating and transmitting a partial OAM beam. For ease of discussion and illustration, the process 700 is discussed below with respect to the antenna system 200 generating the partial OAM beam 222 of FIG. 2A, but the process 700 is not so limited.

As shown, at step 702, the output of the feed antenna 202 can be pointed at a target associated with the partial OAM antenna 204. For example, generally as discussed above, the feed antenna 202 can be pointed at the feed target 260. As noted, the feed target 260 can but need not be at a central location on the face 206 or even substantially at a center point of the face 206.

At step 704, a transmission signal having substantially no OAM can be output from the feed antenna 202. For example, the transmission signal 210 can be output from the feed antenna 202, and the transmission signal 210 can illuminate the face 206 of the partial OAM antenna 204 as discussed above. For example, the transmission signal 210 can be directed at the feed target 260 and/or illuminate substantially all of the face 206. As noted, the transmission signal 210 can have substantially no OAM.

At step 706, the reflective face 206 of the partial OAM antenna 204 can reflect the transmission signal 210 away from the antenna system 200 as a transmitted partial OAM beam, for example, as illustrated by the partial OAM beam 222 in FIG. 2A. Because the face 206 is only a portion of an OAM shaped surface 302 for producing a full OAM beam (e.g., like 102 in FIG. 1A or 224 in FIG. 2A), the partial OAM beam 222 contains only the portion of the equivalent full OAM beam that corresponds to the face 206 generally as discussed above. As discussed above, the shape of the face 206 and thus the partial OAM beam 222 is not limited to the pie shape shown in FIGS. 2A-3D but can take many different shapes and sizes and positions on an OAM shaped surface 302.

Although specific embodiments and applications of the invention have been described in this specification, these embodiments and applications are exemplary only, and many variations are possible.

We claim:

1. An antenna system comprising:

a reflective antenna having a reflective face, a surface of the entire reflective face having a contour that corresponds to a contour of a portion of a geometric surface that is configured to impart a non-zero orbital angular momentum (OAM) to a transmission signal to generate a full OAM beam, the portion being less than the entire geometric surface such that the reflective face is configured to generate a partial OAM beam.

2. The antenna system of claim 1 further comprising a feed antenna positioned to illuminate the reflective face with a transmission signal to thereby cause the partial OAM beam to be generated.

3. The antenna system of claim 1, wherein the geometric surface extends from an outer perimeter to a central point, the central point defining an axis.

4. The antenna system of claim 3, wherein the geometric surface curves concavely from points on the outer perimeter to the central point.

5. The antenna system of claim 3, wherein:

the outer perimeter twists around the axis from a start point to an end point, and the start point is spaced a non-zero distance D from the end point.

6. The antenna system of claim 5, wherein the start point and the end point are on a line that is substantially parallel to the axis.

7. The antenna system of claim 5, wherein the outer perimeter is substantially a spiral about the axis.

8. The antenna system of claim 5, wherein the outer perimeter is substantially a helix about the axis.

9. The antenna system of claim 6, wherein the outer perimeter makes substantially one and only one revolution about the axis.

10. The antenna system of claim 1, wherein the portion is between ten and eighty percent of the entirety of the geometric surface.

11. The antenna system of claim 1, wherein the portion is less than fifty percent of the entirety of the geometric surface.

12. The antenna system of claim 1, wherein at least a portion of an outer perimeter of the surface of the reflective face corresponds to a portion of the outer perimeter of the geometric surface.

13. The antenna system of claim 1, wherein no portion of an outer perimeter of the surface of the reflective face corresponds to a portion of the outer perimeter of the geometric surface.

14. The antenna system of claim 1, wherein an outer perimeter of the surface of the reflective face is pie shaped.

15. The antenna system of claim 1, wherein an outer perimeter of the surface of the reflective face is elliptical or circular.

16. The antenna system of claim 1, wherein an outer perimeter of the surface of the reflective face is in the shape of a partial circular segment.

17. The antenna system of claim 2, wherein the feed antenna directs a center of the transmission signal towards a center of the reflective face.

18. An antenna system for generating a partial OAM beam having a far field pattern that includes a centrally located high intensity field portion, the antenna system comprising:

a reflective antenna having a reflective face, a surface of the entire reflective face having a contour that corresponds to a contour of a portion of a full OAM shaped surface, the portion being less than the entirety of the full OAM shaped surface such that when a transmission signal is reflected from the reflective face the partial OAM beam is formed.

19. The antenna system of claim 18, further comprising:

a feed antenna that directs the transmission signal towards a central point of the reflective face.

20. A method for forming a partial OAM beam comprising:

transmitting, from a feed antenna, a transmission signal towards a central point of a reflective face of a reflective antenna, a surface of the entire reflective face having a contour that corresponds to a contour of a portion of a full OAM shaped surface, the portion being less than the entirety of the full OAM shaped surface such that when the transmission signal is reflected from the reflective face the partial OAM beam is formed having a far field pattern that includes a centrally located high intensity field portion.

* * * * *